US006283791B1

(12) United States Patent
Tai

(10) Patent No.: US 6,283,791 B1
(45) **Date of Patent: *Sep. 4, 2001**

(54) EMI SHIELDED CONNECTOR OF A HUB

(75) Inventor: Hung-Feng Tai, Hsinchu (TW)

(73) Assignee: Accton Technology Corporation, Hsinchu (TW)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/304,469

(22) Filed: May 3, 1999

(51) Int. Cl.[7] ..... H01R 13/648
(52) U.S. Cl. ..... 439/607; 439/609
(58) Field of Search ..... 439/607, 608, 439/609, 610

(56) References Cited

U.S. PATENT DOCUMENTS 5,766,041 * 6/1998 Morin et al. ..... 439/609
5,788,538 * 8/1998 Belopolsky et al. ..... 439/607
6,012,948 * 1/2000 Wu ..... 439/567
6,086,421 * 7/2000 Wu et al. ..... 439/607

* cited by examiner

*Primary Examiner*—Gary Paumen
*Assistant Examiner*—Ross Gushi
(74) *Attorney, Agent, or Firm*—Birch, Stewart, Kolasch & Birch, LLP

(57) ABSTRACT

An EMI shielded connector of a hub is disclosed, which mounts an EMI shield on the connector of a hub to prevent the connector from electromagnetic wave and the interference formed among the connectors when there are a plurality of connectors inside a hub. The EMI shield device is made by a unit of metal sheet. It is very easy to produce such a shield device in this kind of material. The flexibility of the metal sheet is used to combine the EMI shield device and the connector so that it is very easy and convenient to assemble and disassemble the EMI shield device from the connector. Moreover, the EMI device contacts to the terminal and the case of the hub so that the EMI shield device is conductively grounded.

21 Claims, 4 Drawing Sheets

EMI SHIELDED CONNECTOR OF A HUB

BACKGROUND OF THE INVENTION

The present invention relates to an EMI shielded connector of a hub, more particularly to a shield device equipped on a connector of a hub for shielding electromagnetic interference (EMI).

Computer networks have become a part of our daily life in recent years. We can almost get access to every kind of information via the network. Therefore, setting up and constructing a network is necessary in computerized process. Moreover, local area networks (LANs) have been widely utilized in many corporations to make communications more convenient.

Hubs are required when constructing a network. A hub presents the center for signal exchanging. Analog and digital signals can be transmitted, connected regenerated, or amplified via a hub. There are some advantages for using a hub. First, the quality of the network can be highly improved. Second, there is less influence on the sequential nodes of the network when one transmission line of the local area network is disconnected. Therefore, it is important to prevent the signals from interference after the transmission of the signals.

Most electric appliances, especially high frequency appliances such as the signal transmission apparatus, are typically equipped an EMI shield device to prevent signals from the electromagnetic wave or radio frequency interference as to keep good transmission quality. However, there is still no such a design for hubs. Nevertheless, the specification of the frequency bandwidth for transmitting signals of a hub has been improved from 10M Hz to 100M Hz. It is time to take the electromagnetic interference into consideration in designing hubs.

SUMMARY OF THE INVENTION

Therefore, the object of the present invention is to provide an EMI shielded connector of a hub.

The main consideration of the EMI technology is not only in providing a shield effect but also involving the shielded object and the grounding. Thus we have to make an integral design so that we can easily assemble and disassemble the shield device from the connector of the hub and so as not to substantially increase the cost.

Accordingly, the EMI shielded connector of the present invention includes a connector body having a plurality of pins for connecting to the hub and a socket for receiving terminals, and a shield device, which contains means for fixedly clasping the connector body and means for grounding the hub, mounted on the connector body but exposing the socket to shield the connector body form electromagnetic interference.

The shield device mentioned above is made by a unit of metal sheet. The clasping means is a part of the metal sheet, which fixedly clasps the connector body. Moreover, a first protrusion part contacts the terminal and a second protrusion part contacts the case of the hub so that the shield device is conductively connected to the ground. The first protrusion part and the second protrusion part are also part of the metal sheet.

BRIEF DESCRIPTION OF THE DRAWINGS

Other objects, features, and advantages of the invention will become apparent from the following detailed description of the preferred but non-limiting embodiments. The description is made with reference to the accompanying drawings in which.

DESCRIPTION OF THE PREFERRED EMBODIMENTS

Figure 1:
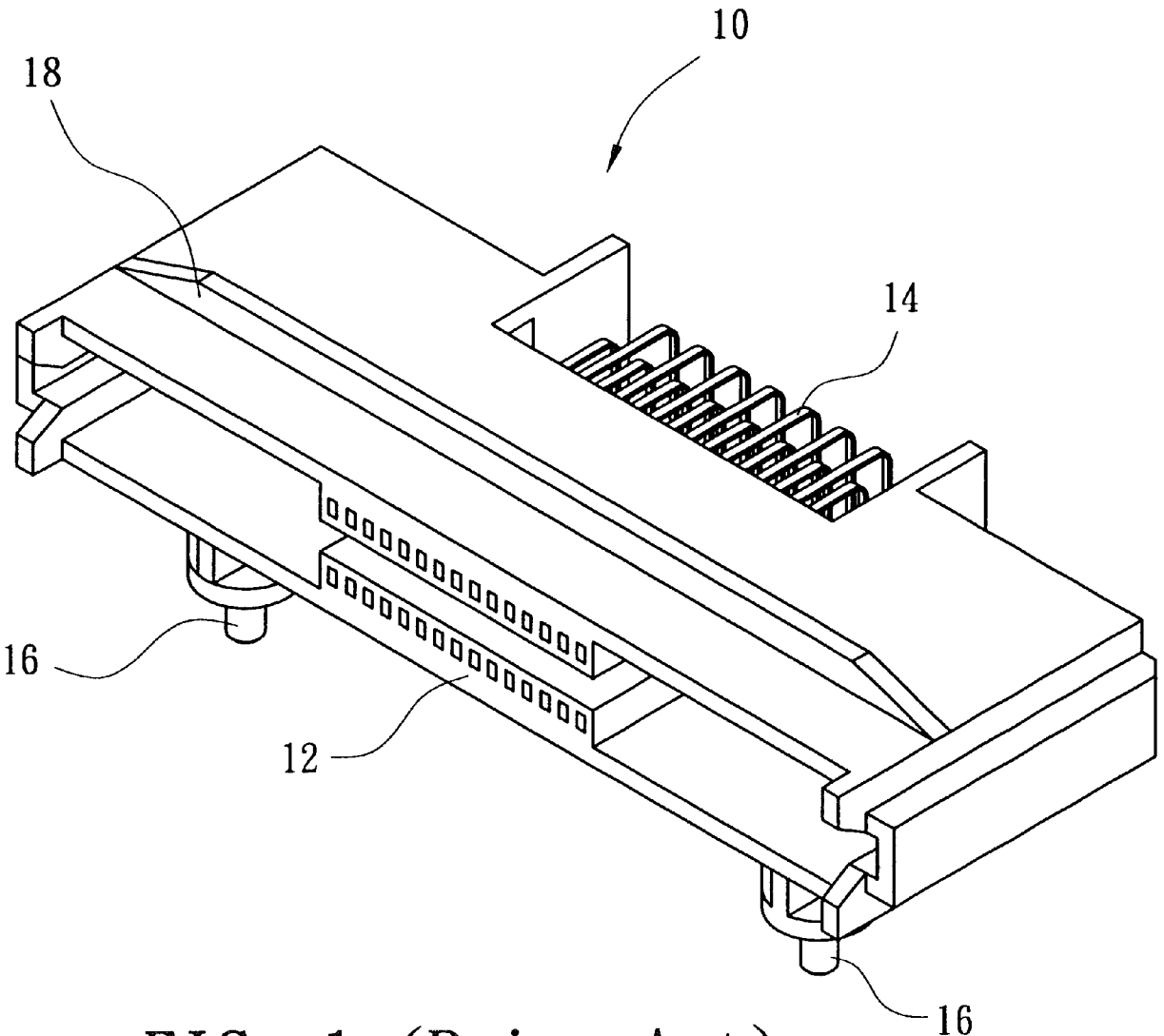
FIG. 1 (Prior Art)
FIG. 1 is a perspective view of the connector of a hub of the prior art.

Referring to the FIG. 1, the connector 10 of a hub includes a socket 12 for connecting to a terminal. The connector 10 has multiple pins 14, which are interposed into the corresponding positions on the circuit board (not shown) inside the hub, and the fixing parts 16 fastens the connector on the circuit board.

A number of connectors, as shown in FIG. 1, are usually equipped inside the hub in order that the lines from computers are connected to the connectors via respective terminals. The hub that interconnects the data of computers and the network is constructed thereafter. Because the high frequency signals are easily interfered by the electromagnetic waves of the surroundings, an EMI shield device is required on the transmission lines. However, the terminals in the connector 10 are exposed in the surroundings, so the signals are very easily interfered by the electromagnetic waves or radio frequency in this exposed part. Therefore, the present invention designs a shield to solve the problem of EMI.

Figure 2:
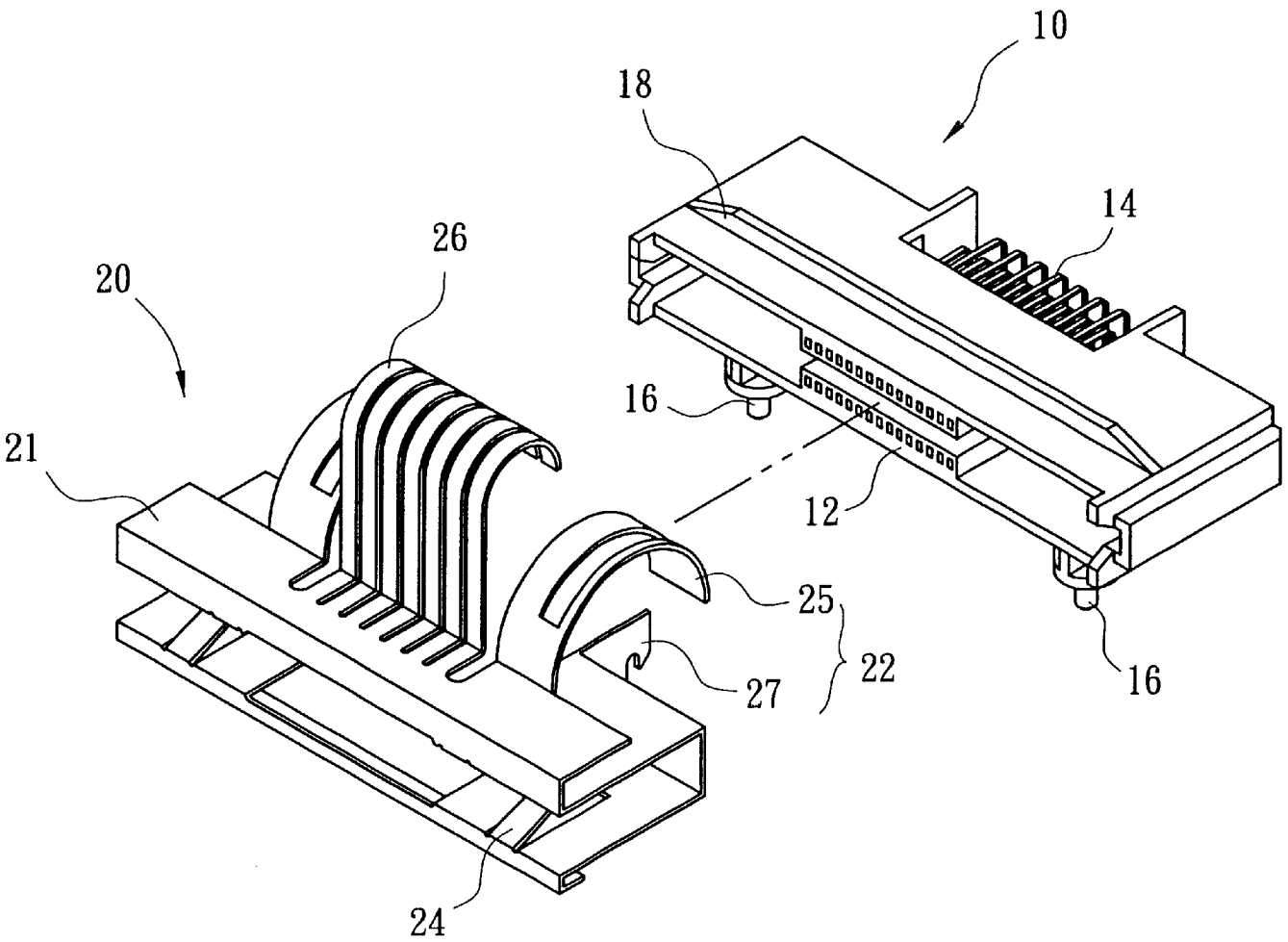
FIG. 2 is a perspective view of the EMI shielded connector of a hub of the present invention.

FIG. 2 shows a preferred embodiment of an EMI shield device of the present invention. As shown in the figure, an shield device 20 includes a clasping means 22, a first protrusion part 24 thereinside and a second protrusion part 26 thereabove. The EMI shield device 20 is designed to match the shape of the connector 10 so that it can combine with the socket 12 properly. The EMI shield device 20 is made by a unit of metal sheet. There are some advantages using metal sheet. First, the production becomes very simple and easy. Second, the EMI shield device properly matches the socket 12, and there is no influence on the operation when a terminal connects with a socket.

Figure 3:
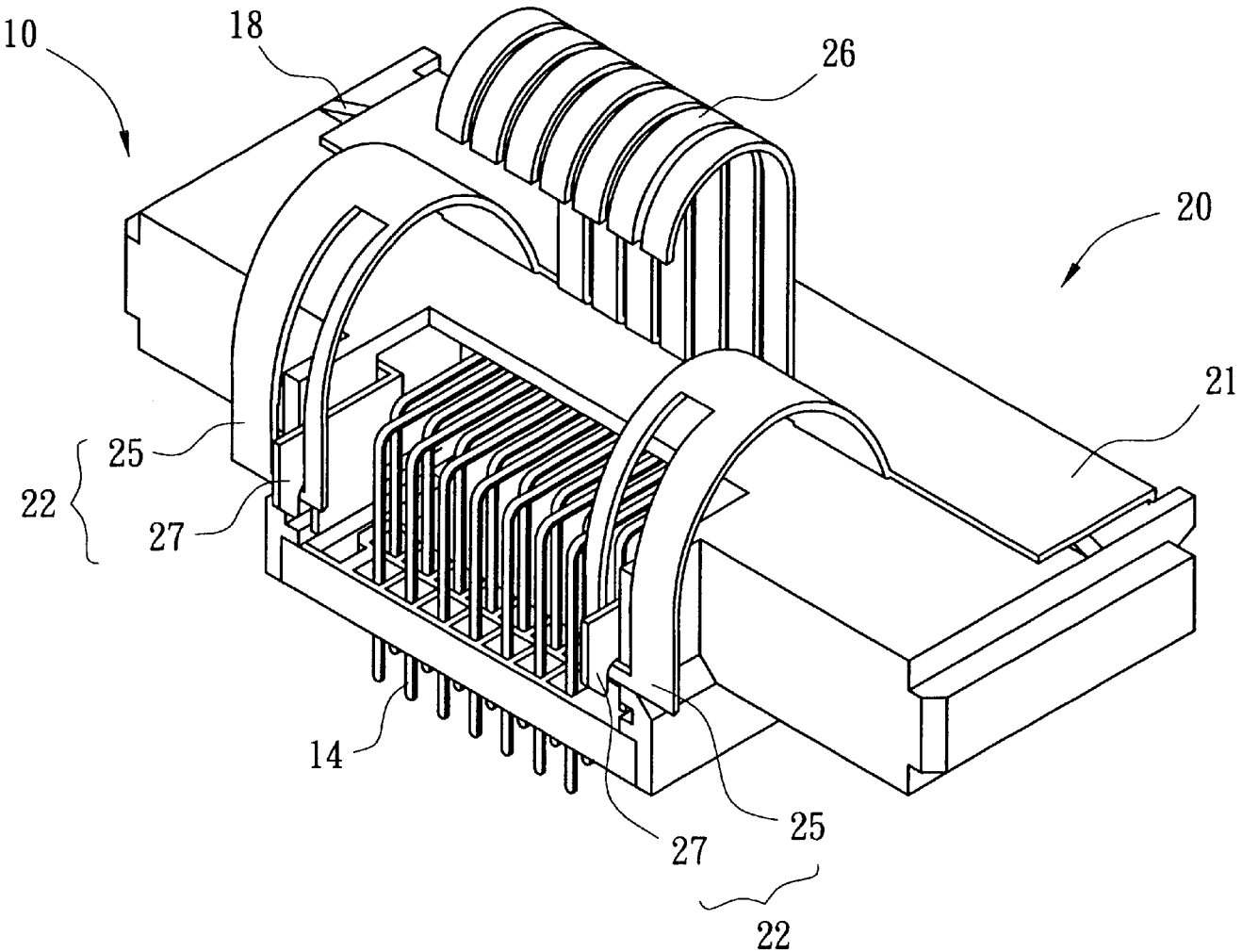
FIG. 3 is another perspective view of FIG. 2 of the present invention; and the present invention, showing the combination between the EMI shield and the connector of a hub.

When assembling the EMI shield device and the connector, the U-shaped body of the EMI shield device 20 is placed into the socket 12 of the connector, and the eaves structure 21 of the connector body is about to lie on the beam 18 of the connector 10. The extension of the eaves structure 21 forms the second protrusion part 26 mentioned above and a pair of clasps 25 belonging to the clasping means 22. When the clasps 25, the second protrusion part 26 or the first protrusion part 24 following are made arc-shaped, the flexibility is formed due to metal material itself. We can utilize their flexibility to fasten the EMI shield device 20 on the connector of a hub 10 with the clasping means 22. The clasps 25 is lightly pressed to make the holes of the clasps 25 combine with the clasp hook 27 which extending from the body of the EMI shield device. This result is illustrated in the FIG. 3. When disassembling the EMI shield device 20 from the connector, the clasps 25 is also lightly pressed and the holes leave the hook thereafter. Thus we can take away the EMI shield device 20 easily.

Figure 4:
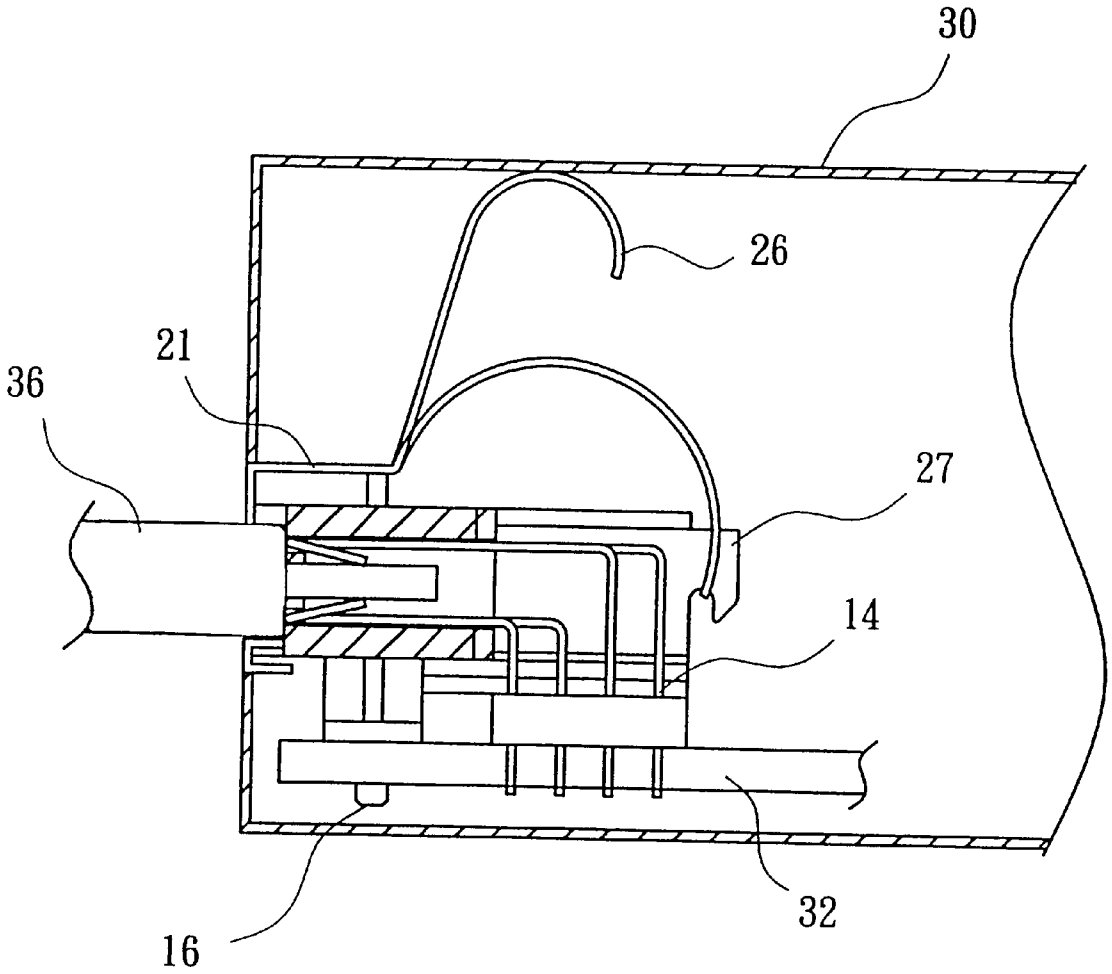
FIG. 4 is a cross-sectional view of the EMI shielded connector connected with a terminal inside the hub.

Another key point of the present invention is the grounding means of the EMI shielded connector of a hub. As shown in the FIG. 4, the pin 14 is interposed on the circuit board 32 and the connector is fastened on the circuit board 32 with the fixing part 16. As shown in the figure, the EMI shield device has been assembled inside the socket 12 and fastened on the connector 10 with the clasping means 22. Moreover, the second protrusion 26 of the EMI shield device 20 contacts to the case 30 of the hub, and the first protrusion 24 of the MEI shield device 20 contacts to the terminal 36. Thus the EMI shield device is conductively grounded.

To be understood, the shape or quantity of the protrusion is not necessarily the same as the preferred embodiment of the present invention as long as the EMI shield device is conductively to the ground. For example, a slice can be used as the second protrusion part 26 rather than strips.

Other embodiments of the invention will appear to those skilled in the art from consideration of the specification and practice of the invention disclosed herein. It is intended that the specification and examples to be considered as exemplary only, with a true scope and spirit of the invention being indicated by the following claims.

What is claimed is:

1. A networking assembly having a plurality of EMI shielded connectors, each of said EMI shielded connectors comprising:

a connector body mounted on the hub, said connector body containing a plurality of pins for connecting to the hub and a socket for receiving a terminal, the connector body having a front side and a rear side, the front side being opposed to the rear side and at least an upper side being provided between the front and rear side of the connector body; and an EMI shield device removably mounted on the connector body for shielding the connector body from electromagnetic wave interference, said EMI shield device including:

clamping means for fixedly clasping the EMI shield device to the connector body, the clamping means including at least one clasp hook and at least one clasp, the at least one clasp hook being insertable into a forward side of the connector body whereafter the clasp hook extends from a rear side of the connector body, the at least one clasp being connected to the EMI shield device and being engageable with the at least one clasp hook, the at least one clasp extending over at least the upper portion of the connector body when engaged with the at least one clasp hook; and grounding means which includes a first protrusion and a second protrusion for grounding the EMI shield device, the first protrusion being formed inside the EMI shield device and the second protrusion being an arc-shaped second protrusion extending from an eaves structure of the shield device and being disposed above said pins.

2. The networking assembly as recited in claim 1, wherein the at least on clasp is flexible and includes a slot provided therein, the at least one clasp being bent over the connector body and the at least one clasp hook being engaged in the slot of the clasp body in order to clamp the EMI shield device to the connector body.

3. The networking assembly as recited in claim 1, wherein the second protrusion includes a plurality of arc-shaped strips extending from the eaves structure of the shield device.

4. The networking assembly as recited in claim 1, wherein the EMI shield device has a U-shape and wherein the first protrusion is located in an interior of the EMI shield device and the second protrusion is located on an exterior of the EMI shield device.

5. The networking assembly as recited in claim 4, wherein the at least on clasp hook extends from a lower portion of the U-shape of the EMI shield device.

6. The networking assembly as recited in claim 1, wherein the entire shield device is made from a single sheet of metal.

7. The networking assembly as recited in claim 6, wherein the clasping means of the shield device flexibly clasps the connector.

8. The networking assembly as recited in claim 6, wherein the grounding means includes a portion of said first protrusion which contacts to said terminal and a portion of said second protrusion which contacts said hub.

9. The networking assembly as recited in claim 1, wherein a pair of clasp hooks are provided as the at least on clasp hook and wherein the plurality of pins of the connector body are between the pair of clasp hooks when the clasp hooks are inserted into the connector body.

10. The networking assembly as recited in claim 9, wherein a pair of clasp are provided as the at least one clasp, each of the clasp hooks having a clasp associated therewith and each of the clasps being flexible and having a slot provided therein, the clasps being bent over the connector body and the associated clasp hooks being engaged in the slots of the clasp bodies in order to clamp the EMI shield device to the connector body.

11. The networking assembly as recited in claim 9, wherein the second protrusion is located between the pair of clasp hooks.

12. A networking assembly having a plurality of EMI shielded connectors connected to a networking hub, each of said EMI shielded connectors comprising:

a connector body mounted on the networking hub, said connector body containing a plurality of pins for connecting to the networking hub and a socket for receiving a terminal;

an EMI shield device removably mounted on the connector body for shielding the connector body from electromagnetic wave interference, said EMI shield device including:

clamping means for fixedly clasping the EMI shield device to the connector body, grounding means which includes a first protrusion and a second protrusion for grounding the EMI shield device, the first protrusion being formed inside the EMI shield device and the second protrusion being an arc-shaped second protrusion extending from an eaves structure of the shield device and being disposed above said pins.

13. The networking assembly as recited in claim 12, wherein the shield device is structured such that the entire shield device is made from a single sheet of metal.

14. The networking assembly as recited in claim 12, wherein said first protrusion contacts said terminal and said second protrusion contacts said networking hub.

15. The networking assembly as recited in claim 12, wherein the at least on clasp is flexible and includes a slot provided therein, the at least one clasp being bent over the connector body and the at least one clasp hook being engaged in the slot of the clasp body in order to clamp the EMI shield device to the connector body.

16. The networking assembly as recited in claim 12, wherein the second protrusion includes a plurality of arc-shaped strips extending from the eaves structure of the shield device.

17. The networking assembly as recited in claim 12, wherein the EMI shield device has a U-shape and wherein the first protrusion is located in an interior of the EMI shield device and the second protrusion is located on an exterior of the EMI shield device.

18. The networking assembly as recited in claim 17, wherein the at least on clasp hook extends from a lower portion of the U-shape of the EMI shield device.

19. The networking assembly as recited in claim 12, wherein a pair of clasp hooks are provided as the at least on clasp hook and wherein the plurality of pins of the connector body are between the pair of clasp hooks when the clasp hooks are inserted into the connector body.

20. The networking assembly as recited in claim 19, wherein a pair of clasp are provided as the at least one clasp, each of the clasp hooks having a clasp associated therewith and each of the clasps being flexible and having a slot provided therein, the clasps being bent over the connector body and the associated clasp hooks being engaged in the slots of the clasp bodies in order to clamp the EMI shield device to the connector body.

21. The networking assembly as recited in claim 19, wherein the second protrusion is located between the pair of clasp hooks.

* * * * *